US009573245B2

(12) United States Patent
Takahashi et al.

(10) Patent No.: US 9,573,245 B2
(45) Date of Patent: Feb. 21, 2017

(54) POLISHING METHOD

(71) Applicant: EBARA CORPORATION, Tokyo (JP)

(72) Inventors: Taro Takahashi, Tokyo (JP); Yasumitsu Kawabata, Tokyo (JP)

(73) Assignee: Ebara Corporation, Tokyo (JP)

( * ) Notice: Subject to any disclaimer, the term of this patent is extended or adjusted under 35 U.S.C. 154(b) by 143 days.

(21) Appl. No.: 14/506,562

(22) Filed: Oct. 3, 2014

(65) Prior Publication Data

US 2015/0099424 A1 Apr. 9, 2015

(30) Foreign Application Priority Data

Oct. 7, 2013 (JP) ..... 2013-210387

(51) Int. Cl.
*B24B 49/00* (2012.01)
*B24B 49/18* (2006.01)
*B24B 37/013* (2012.01)

(52) U.S. Cl.
CPC ..... *B24B 49/18* (2013.01); *B24B 37/013* (2013.01)

(58) Field of Classification Search
USPC ..... 451/5, 41, 287, 288
See application file for complete search history.

(56) References Cited

U.S. PATENT DOCUMENTS

2009/0058409 A1* 3/2009 Fujita ..... B24B 37/013 324/230
2012/0021672 A1* 1/2012 David ..... B24B 37/013 451/6
2013/0337586 A1* 12/2013 Iizumi ..... H01L 22/10 438/16

FOREIGN PATENT DOCUMENTS

JP 07-311019 A 11/1995
JP 09-290363 A 11/1997
JP 2005-121616 5/2005
JP 2009-026850 A 2/2009
JP 2009-283868 A 12/2009

* cited by examiner

*Primary Examiner* — Joseph J Hail
*Assistant Examiner* — Shantese McDonald
(74) *Attorney, Agent, or Firm* — Baker & Hostetler LLP

(57) ABSTRACT

A polishing method includes: rotating a polishing table that supports a polishing pad; polishing a conductive film by pressing a substrate having the conductive film against the polishing pad; obtaining a film thickness signal with use of an eddy current film-thickness sensor disposed in the polishing table; determining a thickness of the polishing pad based on the film thickness signal; determining a polishing rate of the conductive film corresponding to the determined thickness of the polishing pad; calculating an expected amount of polishing of the conductive film to be polished at the determined polishing rate for a predetermined polishing time; calculating a temporary end-point film thickness by adding the expected amount of polishing to a target thickness; and terminating polishing of the conductive film when the predetermined polishing time has elapsed from a point of time when the thickness of the conductive film has reached the temporary end-point film thickness.

4 Claims, 9 Drawing Sheets

POLISHING METHOD

CROSS REFERENCE TO RELATED APPLICATION

This document claims priority to Japanese Patent Application Number 2013-210387 filed Oct. 7, 2013, the entire contents of which am hereby incorporated by reference.

BACKGROUND

In fabrication of semiconductor devices, a process of polishing a conductive film, such as a metal film, formed on a substrate is performed. For example, in a metal interconnect forming process, the metal film is formed on a surface of the substrate having interconnect patterns formed thereon and then chemical mechanical polishing (CMP) is performed to remove an excessive metal film, thereby forming metal interconnects. In this polishing process, in order to detect a polishing end point at which a desired target thickness is reached, an eddy current film-thickness sensor is used to measure the thickness of the conductive film formed on the substrate (see Japanese laid-open patent publication No. 2005-121616).

The eddy current film-thickness sensor is disposed in a rotatable polishing table, and rotates together with the polishing table that is rotating for polishing the substrate. A high-frequency alternating current is flowing in the eddy current film-thickness sensor. When the eddy current film-thickness sensor moves near the substrate, an eddy current is generated in the conductive film famed on the substrate due to an influence of the high-frequency alternating current. An impedance of an electric circuit of the eddy current film-thickness sensor varies under the influence of magnetic lines of force of the generated eddy current. The thickness of the conductive film can be detected based on a film thickness signal indicating the variation in the impedance.

The detection of the thickness of the conductive film has been conventionally performed in this manner with use of the eddy current film-thickness sensor. However, it is difficult to terminate the polishing process immediately at a point of time when a target thickness is actually reached. This reason is that the film-thickness detection entails a detection delay time and that it takes a certain time to actually stop the polishing of the conductive film. Therefore, in the conventional polishing process, a temporary end-point film thickness is set in advance by adding a predetermined offset value to the target thickness at which polishing is to be actually stopped, and polishing of the conductive film is continued just for a predetermined polishing time after the temporary end-point film thickness is detected.

This method using such an offset value does not raise any problem if a polishing rate of the conductive film is constant at all times. However, the polishing rate may actually vary depending on polishing pad conditions, such as a thickness of the polishing pad. Therefore, if the polishing rate is higher than usual, the polishing is continued until the film thickness becomes smaller than the target thickness, and if the polishing rate is lower than usual, the polishing is terminated at a film thickness larger than the target thickness. Therefore, the film thickness after polishing may vary with respect to the target thickness depending on the polishing pad conditions, such as the thickness of the polishing pad.

Furthermore, since the eddy current film-thickness sensor obtains the film thickness signal each time the polishing table makes one rotation as described above, it is not possible to obtain a polishing precision finer than an amount of polishing per one rotation of the polishing table.

SUMMARY OF THE INVENTION

According to an embodiment, there is provided a polishing method which can polish a conductive film to a target thickness more precisely.

Embodiments, which will be described below, relate to a polishing method for polishing a conductive film, such as a metal film, formed on a substrate, such as a wafer, and more particularly relates to a polishing method for polishing the conductive film with precision while detecting a thickness of the conductive film with use of an eddy current film-thickness sensor.

In an embodiment, there is provided a polishing method, comprising: rotating a polishing table that supports a polishing pad; polishing a conductive film by pressing a substrate, having the conductive film formed on a surface thereof, against the polishing pad; obtaining a film thickness signal, which varies in accordance with a thickness of the conductive film, with use of an eddy current film-thickness sensor disposed in the polishing table; determining a thickness of the polishing pad based on the film thickness signal; determining a polishing rate of the conductive film corresponding to the determined thickness of the polishing pad; calculating an expected amount of polishing of the conductive film to be polished at the determined polishing rate for a predetermined polishing time; calculating a temporary end-point film thickness by adding the expected amount of polishing to a target thickness of the conductive film; and terminating the polishing of the conductive film when the predetermined polishing time has elapsed from a point of time when the thickness of the conductive film has reached the temporary end-point film thickness.

In an embodiment, the polishing rate is determined from a polishing rate data indicating a relationship between thickness of the polishing pad and corresponding polishing rate.

In an embodiment, the film thickness signal comprises a resistance component and an inductive reactance component of an electric circuit of the eddy current film-thickness sensor, and the thickness of the polishing pad is determined from a pad thickness data indicating a relationship between thickness of the polishing pad and impedance that is calculated from the resistance component and the inductive reactance component.

In an embodiment, there is provided a polishing method, comprising: rotating a polishing table that supports a polishing pad; polishing a conductive film by pressing a substrate, having the conductive film formed on a surface thereof, against the polishing pad; obtaining a thickness of the conductive film from output values of an eddy current film-thickness sensor disposed in the polishing table; calculating an amount of polishing of the conductive film per one rotation of the polishing table; calculating an additional polishing time from the amount of polishing of the conductive film and a difference between a current thickness of the conductive film and a target thickness; calculating a target polishing time by adding the additional polishing time to a current polishing time at which the current thickness is obtained; and terminating the polishing of the conductive film when the target polishing time is reached.

According to the above-described embodiments, detection of a polishing end point of the conductive film can be achieved based on the polishing rate that varies depending on the thickness of the polishing pad. Therefore, the accurate polishing of the conductive film to the target thickness becomes possible.

According to the above-described embodiments, the target polishing time, at which the target thickness is reached, is calculated based on the amount of polishing per one rotation of the polishing table. That is, the polishing end point is determined based not on the thickness of the conductive film, but on the polishing time. Therefore, the polishing precision finer than the amount of polishing per one rotation of the polishing table can be obtained.

DETAILED DESCRIPTION OF EMBODIMENTS

Embodiments will be described with reference to the drawings.

Figure 1:
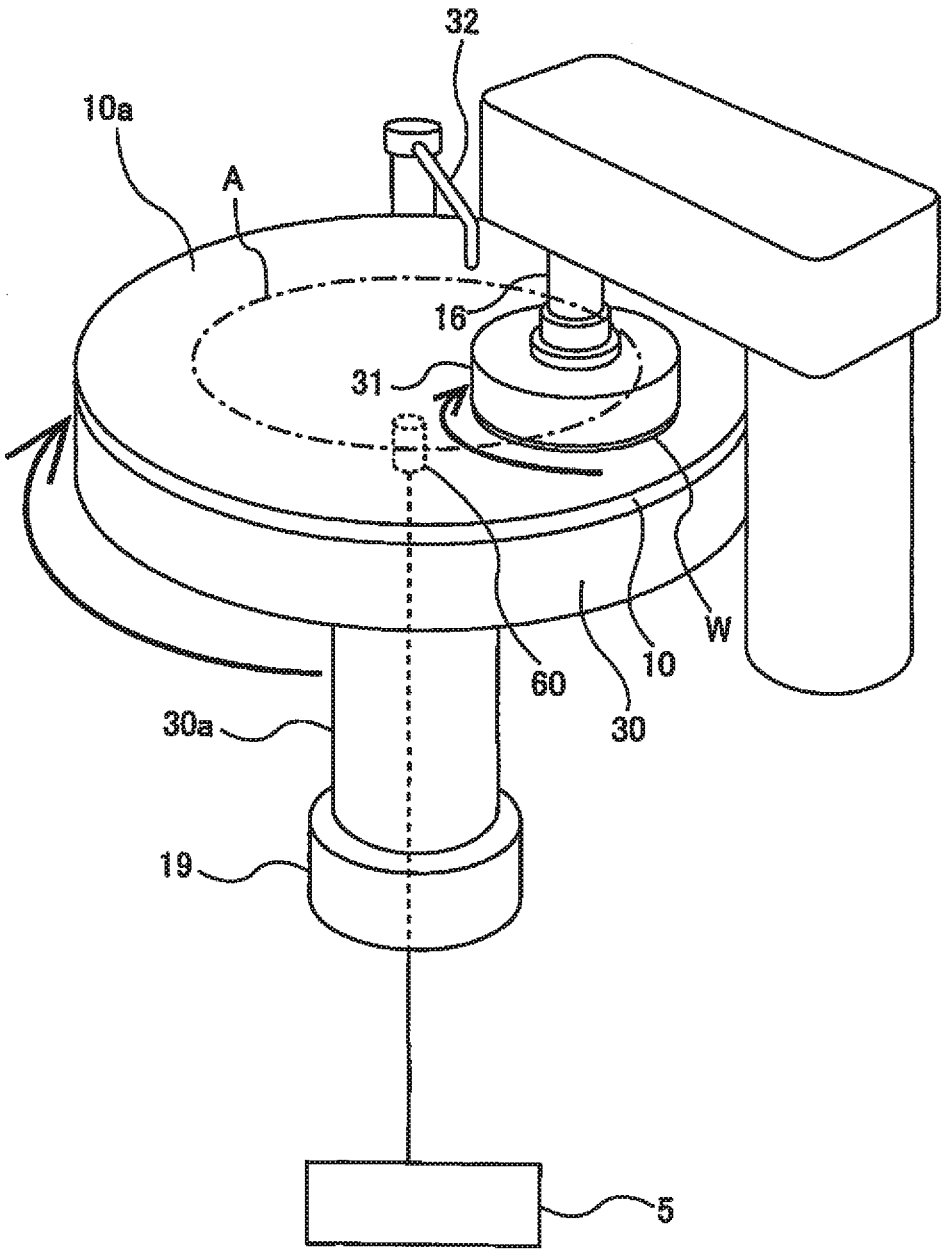
FIG. 1 is a perspective view schematically showing a polishing apparatus capable of performing an embodiment of a polishing method according to an embodiment.

FIG. 1 is a perspective view schematically showing a polishing apparatus capable performing an embodiment of a polishing method according to an embodiment. As shown in FIG. 1, a polishing table 30 is coupled to a table motor 19 through a table shaft 30*a*, so that the polishing table 30 is rotated by the table motor 19 in a direction indicated by arrow. The table motor 19 is located below the polishing table 30. A polishing pad 10 is attached to an upper surface of the polishing table 30. The polishing pad 10 has an upper surface 10*a*, which provides a polishing surface for polishing a substrate W, such as a wafer. A top ring 31 is secured to a lower end of a top ring shaft 16. The top ring 31 is configured to hold the wafer W on its lower surface by vacuum suction. The top ring shaft 16 is elevated and lowered by an elevating mechanism (not shown in the drawing).

An eddy current film-thickness sensor 60 for obtaining film thickness signal that varies accordance with a thickness of a conductive film formed on a since of the substrate W is disposed in the polishing table 30. The eddy current film-thickness sensor 60 is rotated together with the polishing table 30 as illustrated by symbol A and obtains the film thickness signal of the conductive film of the substrate W held by the top ring 31. The eddy current film-thickness sensor 60 is coupled to a processor 5 so that the film thickness signal, obtained by the eddy current film-thickness sensor 60, is transmitted to the processor 5. The processor 5 is configured to produce from the film thickness signal a film thickness index value that directly or indirectly indicates the Thickness of the conductive film of the substrate W.

The substrate W is polished as follows. The top ring 31 and the polishing table 30 are rotated in directions as indicated by arrows, while a polishing liquid (i.e., slurry) is supplied onto the polishing pad 10 from a polishing liquid supply nozzle 32. In this state, the top ring 31, holding the substrate W on its lower surface, is lowered by the top ring shaft 16 and presses the substrate W against the polishing surface 10*a* of the polishing pad 10. The surface of the substrate W is polished by a mechanical action of abrasive grains contained in the polishing liquid and a chemical action of the polishing liquid.

Figure 2:
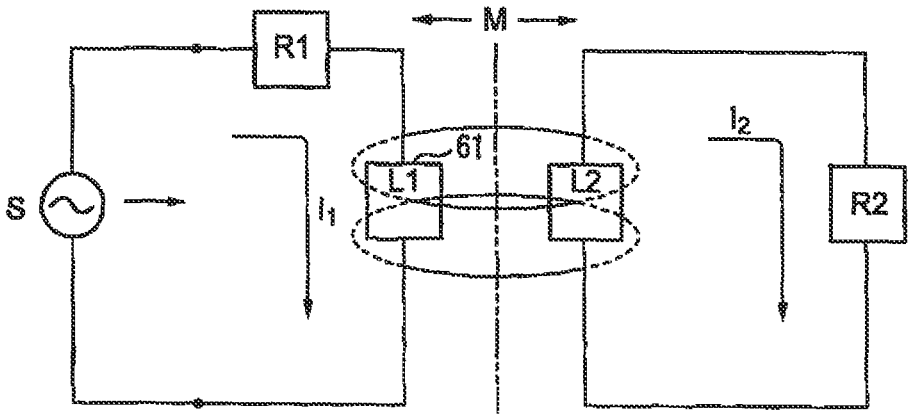
FIG. 2 is a diagram showing a circuit illustrating the principle of an eddy current film-thickness sensor.

Next, thickness detection of the conductive film with use of the eddy current film-thickness sensor 60 will be described. The eddy count film-thickness sensor 60 is configured to pass a high-frequency alternating current to a coil so as to induce an eddy current in the conductive film formed on the surface of the substrate W and detect the thickness of the conductive film from a change in the impedance due to a magnetic field produced by the induced eddy current. FIG. 2 is a diagram showing a circuit for illustrating the principle of the eddy current film-thickness sensor 60. When an AC power supply S (a voltage E [V]) passes a high-frequency alternating current $I_1$ to a coil 61 of the eddy current film-thickness sensor 60, magnetic lines of force, induced in the coil 61, pass through the conductive film of the substrate. As a result, mutual inductance occurs between a sensor-side circuit and a conductive-film-side circuit, and an eddy current $I_2$ flows in the conductive film. This eddy current $I_2$ generates magnetic lines of force, which cause a change in an impedance of the sensor-side circuit. The eddy current film-thickness sensor 60 measures the thickness of the conductive film from the change in the impedance of the sensor-side circuit.

In the sensor-side circuit and the conductive-film-side circuit in FIG. 2, the following equations hold.

$$R_1I_1+L_1dI_1/dt+MdI_2/dt=E \quad (1)$$

$$R_2I_2+L_2dI_2/dt+MdI_1/dt=0 \quad (2)$$

where M represents mutual inductance, $R_1$ represents equivalent resistance of the sensor-side circuit including the coil 61 of the eddy current film-thickness sensor 60, $L_1$ represents self-inductance of the sensor-side circuit including the coil 61, $R_2$ represents equivalent resistance of the conductive film in which the eddy current is induced, and $L_2$ represents self-inductance of the conductive film through which the eddy current flows.

Letting $I_n=A_n e^{j\omega t}$ (sine wave), the above equations (1) and (2) are expressed as follows.

$$(R_1+j\omega L_1)I_1+j\omega MI_2=E \quad (3)$$

$$(R_2+j\omega L_2)I_2+j\omega MI_1=0 \quad (4)$$

From these equations (3) and (4), the following equations (5) are derived.

$$\begin{aligned} I_1 &= E(R_2+j\omega L_2)/[(R_1+j\omega L_1)(R_2+j\omega L_2)+\omega^2M^2] \\ &= E/[(R_1+j\omega L_1)+\omega^2M^2/(R_2+j\omega L_2)] \end{aligned} \quad (5)$$

Thus, the impedance Φ of the sensor-side circuit is given by the following equation (6).

$$\begin{aligned} \Phi &= E/I_1 \\ &= [R_1+\omega^2M^2R_2/(R_2^2+\omega^2L_2^2)]+ \\ &\quad j\omega[L_1-\omega^2L_2M^2/(R_2^2+\omega^2L_2^2)] \end{aligned} \quad (6)$$

Substituting X and Y for a real part (i.e., a resistance component) and an imaginary part (i.e., an inductive reactance component) respectively, the above equation (6) is expressed as follows.

$$\Phi=X+j\omega Y \quad (7)$$

The eddy current film-thickness sensor 60 outputs the resistance component X and the inductive reactance component Y of the impedance of the electric circuit including the coil 61 of the eddy current film-thickness sensor 60. The resistance component X and the inductive reactance component Y are the film thickness signal reflecting the film thickness and vary in accordance with the thickness of the conductive film formed on the substrate.

Figure 3:
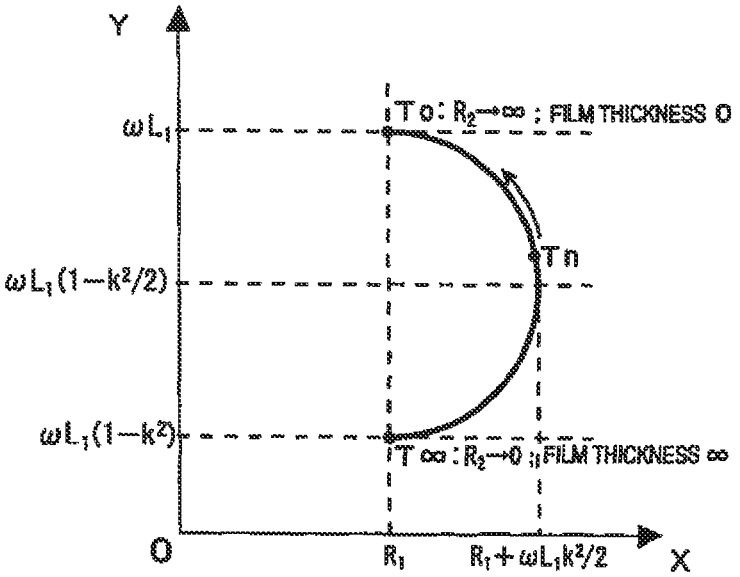
FIG. 3 is a graph showing a circular path of a resistance component X and a reactance component Y, which vary with a change in a thickness of a conductive film, on an impedance coordinate plane.

FIG. 3 is a diagram showing a graph drawn by plotting X and Y, which vary with the thickness of the conductive film, on an XY coordinate system. Coordinates of a point T∞ are values of X and Y when the film thickness is infinity i.e., $R_2$ is zero. Where electrical conductivity of a substrate can be neglected, coordinates of a point T0 are values of X and Y when the film thickness is zero, i.e., $R_2$ is infinity. A point Tn, specified by the values of X and Y, moves in a circular arc toward the point T0 as the thickness of the conductive film decreases. A symbol k in FIG. 3 represents coupling coefficient, and the following relationship (8) holds.

$$M=k(L_1L_2)^{1/2} \quad (8)$$

Figure 4:
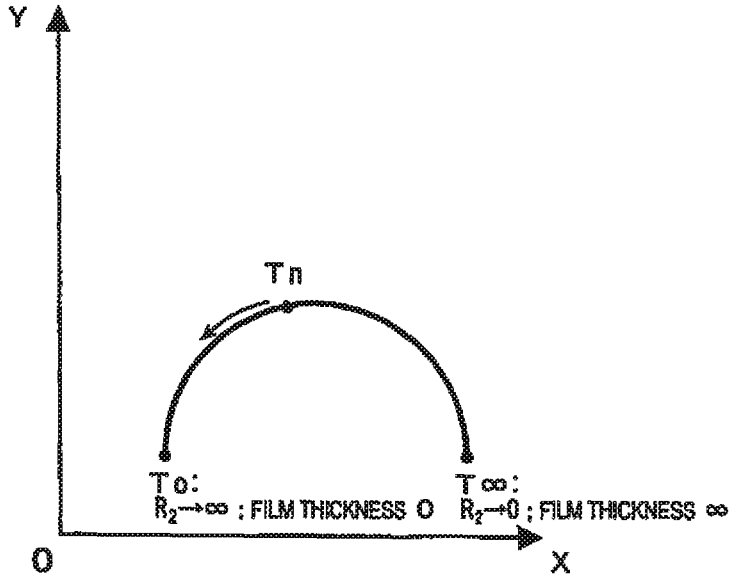
FIG. 4 is a graph obtained by rotating the graph in FIG. 3 in a counterclockwise direction through 90 degrees and then translating the rotated graph.

FIG. 4 shows a graph obtained by rotating the graph in FIG. 3 through 90 degrees in a counterclockwise direction and further translating the resulting graph. As shown in FIG. 4, the point Tn, which is specified by the values of X and Y, moves in a circular arc toward the point T0 as the film thickness decreases.

Figure 5:
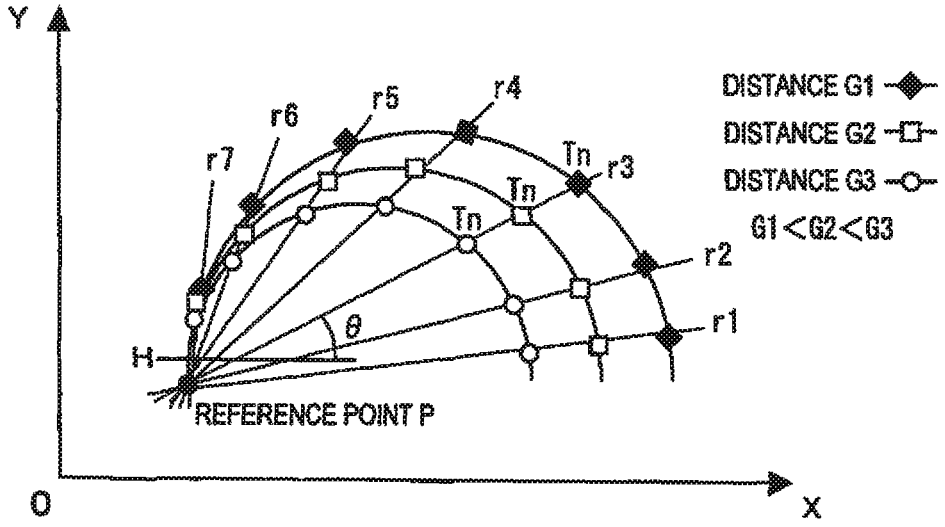
FIG. 5 is a graph showing a manner of a change in an arcuate path of coordinates X and Y in accordance with a distance corresponding to a thickness of a polishing pad in use.

A distance G between the coil 61 of the eddy current film-thickness sensor 60 and the substrate W changes in accordance with a thickness of the polishing pad 10 that exists between the coil 61 and the substrate W. As a result, as shown in FIG. 5, the arcuate path of the coordinates X, Y changes in accordance with the distance G (G1 to G3) corresponding to the thickness of the polishing pad 10. As can be seen from FIG. 5, when points specified by the components X and Y at the same thickness of the conductive film are connected by respective lines (which will be referred to as preliminary measurement lines) with different distances G between the coil 61 and the substrate W, these preliminary measurement lines ($r_1$, $r_2$, $r_3$, . . . ) intersect each other at an intersection (a reference point) P. Each of these preliminary measurement lines rn (n=1, 2, 3 . . . ) is inclined at an angle θ with respect to a predetermined reference line (e.g., a horizontal line H in FIG. 5). This angle θ varies depending on the thickness of the conductive film. Therefore, the angle θ is a film thickness index value indicating the thickness of the conductive film formed on the substrate W. Where the thicknesses of the conductive film are the same, the angles θ are also the same regardless of a difference in the thickness of the polishing pad 10.

Figure 6:
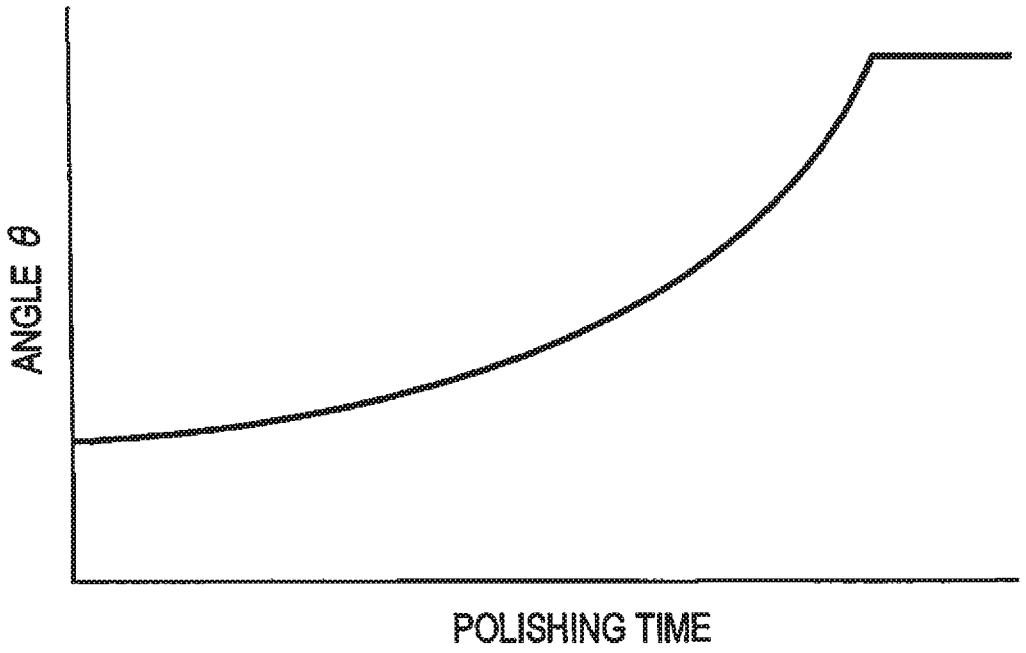
FIG. 6 is a graph showing an angle θ that varies with a polishing time.

When polishing of the substrate W is performed, the processor 5 determines the film thickness from the angle θ with reference to correlation data indicating a relationship between the angle θ and the film thickness. This correlation data is obtained in advance by polishing the same type of substrate as the substrate W, to be polished, and measuring the film thickness corresponding to each angle θ. FIG. 6 is a graph showing the angle θ that varies with the polishing time. Vertical axis represents the angle θ, and horizontal axis represents the polishing time. As shown in this graph, the angle θ increases with the polishing time, and becomes constant at a certain point of time. Therefore, the processor 5 calculates the angle θ during polishing and determines a current thickness of the conductive film from the angle θ.

Figure 7:
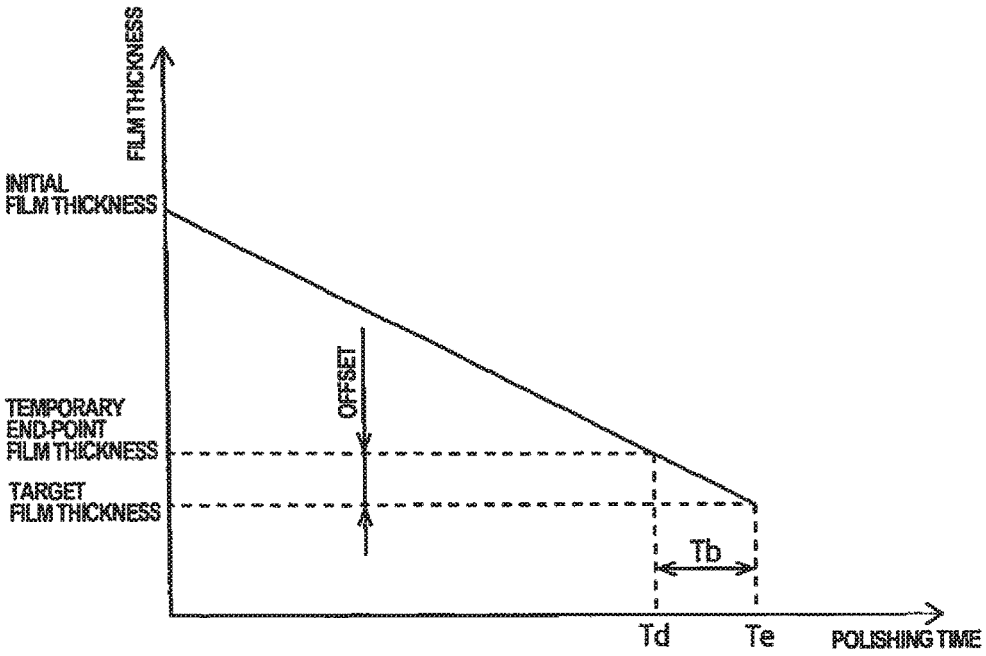
FIG. 7 is a graph showing a change in film thickness when polishing of the conductive film is continued just for a predetermined polishing time after a temporary end-point film thickness is reached so that a desired target thickness is obtained.

The polishing apparatus polishes the conductive film of the substrate W, while obtaining the thickness of the conductive film of the substrate W with use of the eddy current film-thickness sensor 60. However, it is difficult to terminate the polishing process immediately at a point of time when a desired target thickness is actually reached. This reason is that the film thickness detection entails a detection delay time and that it takes a certain time to actually stop the polishing of the conductive film. Therefore, in an actual polishing process, as shown in FIG. 7, a temporary end-point film thickness is established in advance by adding a predetermined offset value to the target thickness at which polishing of the conductive film is to be actually stopped, and polishing of the conductive film is continued just for a predetermined polishing time Tb after the temporary end-point film thickness is reached, so that a desired target thickness is realized.

Figure 8:
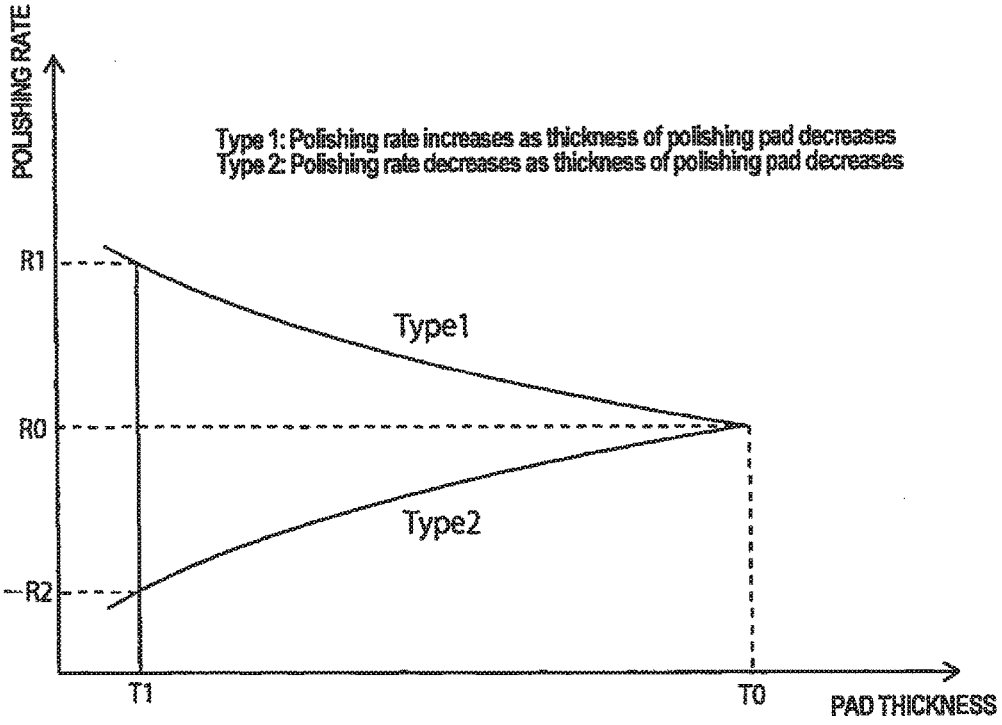
FIG. 8 is a graph showing a polishing rate that varies depending on the thickness of the polishing pad.

This method of using such an offset value does not raise any problem if a polishing rate of the conductive film is constant at all times. However, the polishing rate may actually vary depending on polishing pad conditions, such as the thickness of the polishing pad. Therefore, if the polishing rate is higher than usual, the polishing is continued until the film thickness becomes smaller than the target thickness, and if the polishing rate is lower than usual, the polishing is terminated at a film thickness larger than the target thickness. FIG. 8 shows a graph showing the polishing rate that varies depending on the thickness of the polishing pad 10. Vertical axis represent the polishing rate of the conductive film, and horizontal axis represents the thickness of the polishing pad. The graph in FIG. 8 shows a case where the polishing rate increases as the pad thickness decreases (Type 1) and a case where the polishing rate decreases as the pad thickness decreases (Type 2). Whether the polishing rate increases or decreases with the decrease in the pad thickness depends not only on a material and a property of the polishing pad itself, but also on a polishing process applied.

Figure 9:
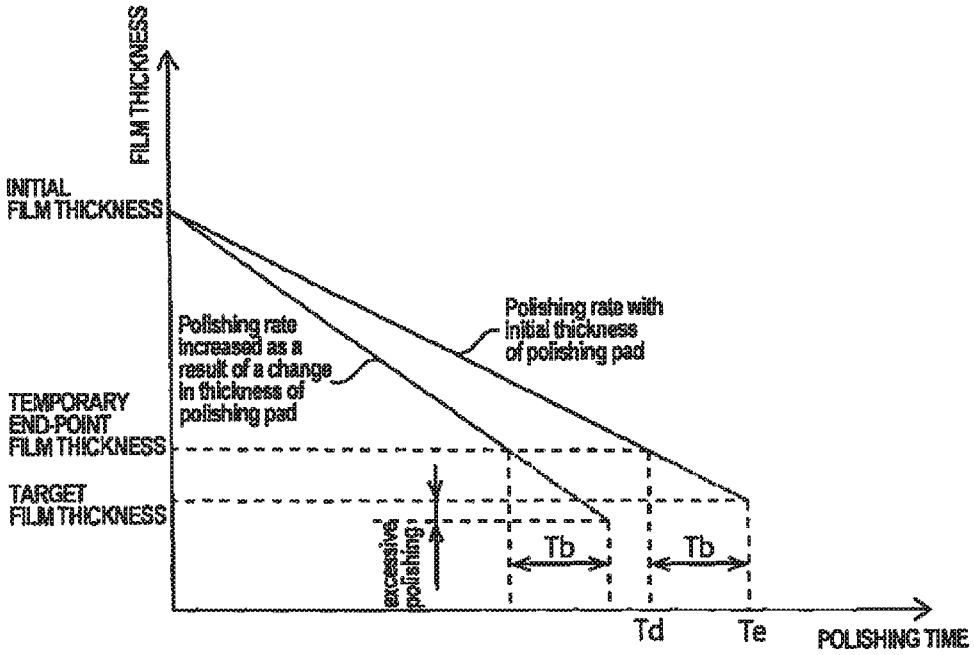
FIG. 9 is a graph illustrating an example in which excessive polishing occurs when the polishing rate increases.

Since the polishing rate varies depending on the thickness of the polishing pad 10 in this manner, if the conductive film is polished for the predetermined polishing time Tb after the temporary end-point film thickness is reached, the thickness of the polished film may vary with respect to the desired target thickness. FIG. 9 shows a graph illustrating an example in which excessive polishing occurs when the polishing rate increases. As can be seen from FIG. 9, if the polishing is continued for the predetermined polishing time Tb after the temporary end-point film thickness is reached under the increased polishing rate condition, the excessive polishing occurs.

Thus, in this embodiment, the processor 5 determines the thickness of the polishing pad 10 from the film thickness signal obtained by the eddy current film-thickness sensor 60, determines the polishing rate corresponding to the determined thickness of the polishing pad 10, calculates an expected amount of polishing of the conductive film with an assumption that the conductive film is polished at the determined polishing rate for the predetermined polishing time Tb, establishes a temporary end-point film thickness by adding this expected amount of polishing as an offset value to the target thickness, and terminates the polishing of the conductive film when the predetermined polishing time Tb has elapsed from a point of time when the temporary end-point film thickness is reached. This embodiment of the polishing method will be described below.

First, as described above, the eddy current film-thickness sensor 60 outputs the resistance component X and the inductive reactance component Y reflecting the thickness of the conductive film, and the processor 5 obtains the angle θ from the resistance component X and the inductive reactance component Y. As shown in FIG. 5, this angle θ is an angle of the line that connects the point Tn, specified by the coordinates X and Y on the XY coordinate system, to the reference point P, with respect to the horizontal line H. The point Tn moves in a semicircular arc as the film thickness decreases. The angle θ also varies with this movement of the point Tn. This angle θ varies depending on the film thickness, but does not vary regardless of the change in the pad thickness.

Figure 10:
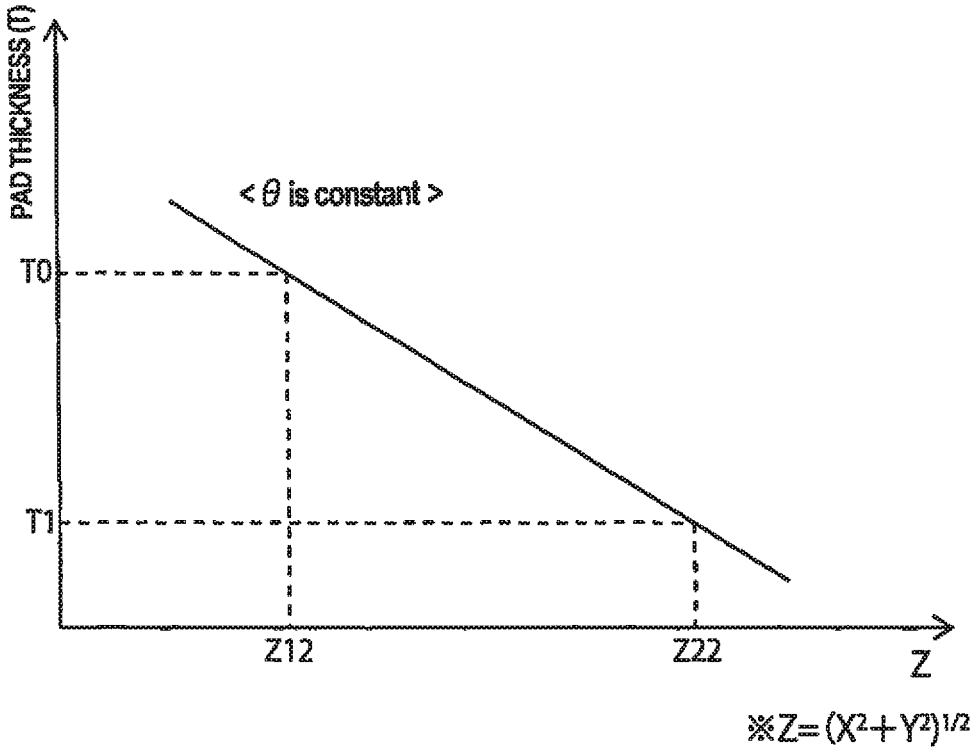
FIG. 10 is a graph showing a relationship between the thickness of the polishing pad and impedance Z calculated from the output values X, Y of the eddy current film-thickness sensor in the case where the angle θ is constant.

Under a condition that the film thickness is constant (i.e., the angle θ is constant), the impedance Z $(=X^2+Y^2)^{1/2})$ varies in inverse proportion to the thickness of the polishing pad. More specifically, the impedance Z, i.e., a distance from the original point O to the point Tn (see FIG. 5), increases as the thickness of the polishing pad decreases. FIG. 10 shows a graph as a pad thickness data indicating a relationship between the thickness of the polishing pad and the impedance Z under the condition that the angle θ is constant. In FIG. 10, vertical axis represents the thickness of the polishing pad, and horizontal axis represents the impedance Z $(=(X^2+Y^2)^{1/2})$. This pad thickness data is prepared in advance with respect to at least one angle θ, so that the thickness of the polishing pad can be determined from the angle θ and the sensor outputs X and Y obtained. The pad thickness data shown in FIG. 10 is obtained in advance from different thicknesses of the polishing pad and impedances Z calculated from corresponding sensor outputs, and is stored in the processor 5.

Next, the processor 5 determines the polishing rate corresponding to the determined thickness of the polishing pad 10. A relational expression representing a relationship between the thickness of the polishing pad 10 and the polishing rate as shown in FIG. 8 is prepared in advance as a polishing rate data. The polishing rate can be determined from the thickness of the polishing pad 10 with use of this relational expression. The polishing rate data that indicates the relationship between the thickness of the polishing pad 10 and the polishing rate may be a table that stores thicknesses of the polishing pad and corresponding polishing rates. The polishing rate data is obtained in advance from actually measured values of the polishing rate obtained when the conductive film is polished with use of a plurality of polishing pads having different thicknesses, and is stored in the processor 5.

Figure 11:
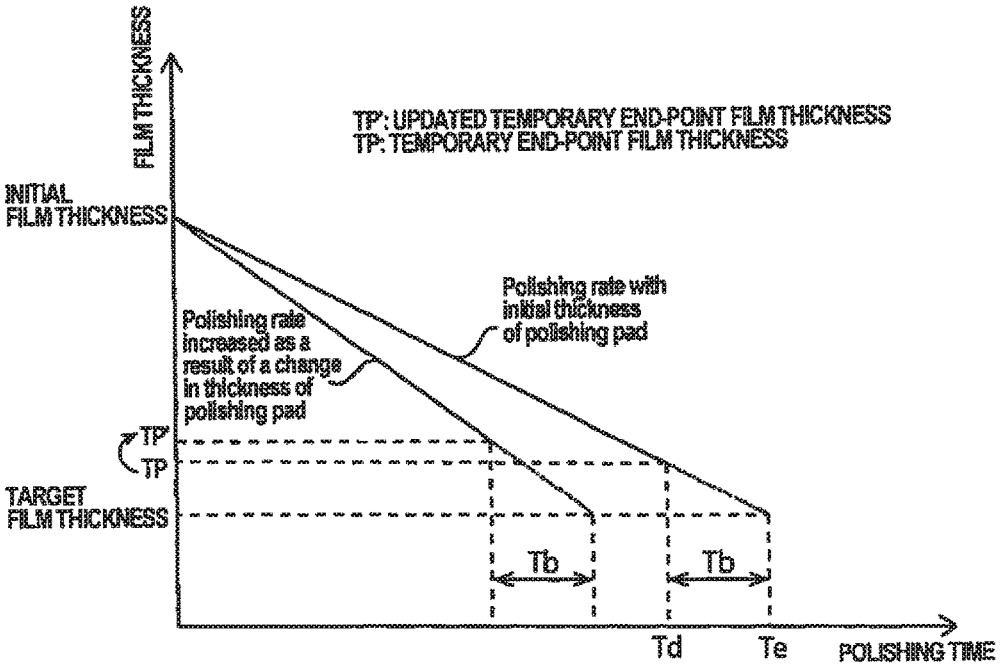
FIG. 11 is a graph showing a manner in which the temporary end-point film thickness is shifted.

The processor 5 then calculates an expected amount of polishing of the conductive film to be polished at the determined polishing rate for the predetermined polishing time Tb. This expected amount of polishing is calculated by multiplying the determined polishing rate by the polishing time Tb. The processor 5 establishes the temporary end-point film thickness by adding this expected amount of polishing as an offset value to the predetermined target thickness. FIG. 11 shows an example in which the excessive polishing is prevented by raising the temporary end-point film thickness in the case where the excessive polishing can occur due to the increase in the polishing rate as shown in FIG. 9. The processor 5 determines the thickness of the polishing pad 10 as described above, determines the polishing rate from the thickness of the polishing pad 10, calculates the offset value by multiplying the polishing rate by the predetermined polishing time Tb, establishes the temporary end-point film thickness by adding the offset value to the target thickness, and terminates the polishing of the substrate when the predetermined polishing time Tb has elapsed from a point of time when the temporary end-point film thickness is reached.

According to the polishing method discussed above, the detection of the polishing end point of the conductive film can be achieved based on the actual polishing rate, because the temporary end-point film thickness is established based on the polishing rate that varies in accordance with the thickness of the polishing pad. Therefore, the conductive film can be polished to the target thickness more precisely.

Next, a polishing method according to another embodiment will be described. In this method, the processor 5 first obtains a thickness FT(n) of the conductive film of the substrate W when the polishing table 30 is making an n-th rotation. The detection of the film thickness is performed by the above-described film-thickness detection method using the angle θ. The processor 5 counts the total number of rotations of the polishing table 30 from a start of polishing, and further measures a polishing time of the conductive film. Further, the processor 5 obtains a thickness FT(n+1) of the conductive film of the substrate W when the polishing table 30 is making a (n+1)-th rotation. This (n+1)-th rotation may be the latest rotation. An amount of polishing per one rotation of the polishing table 30 can be calculated from a difference between the thickness of the conductive film at the n-th rotation of the polishing table 30 and the thickness of the conductive film at the (n+1)-th rotation of the polishing table 30.

More specifically, the processor 5 calculates the amount of polishing per one rotation of the polishing table 30 with use of the following equation (9).

$$\text{The amount of polishing per one rotation} = FT(n) - FT(n+1) \quad (9)$$

Once the amount of polishing per one rotation of the polishing table 30 is calculated, a target polishing time for achieving a predetermined target thickness can be calculated from a current thickness of the conductive film, the predetermined target thickness, and a rotational speed of the polishing table 30. Specifically, the processor 5 calculates the target polishing time using the following equation (10).

$$\begin{aligned}\text{The target polishing time} &= \\ &\text{a current polishing time} + \text{an additional polishing time} = \\ &\text{the current polishing time} + \\ &(\text{the current thickness} - \text{the target thickness})/ \\ &(\text{the amount of polishing per one rotation} \times TS)\end{aligned} \tag{10}$$

when TS is the rotational speed of the polishing table 30 [$\text{min}^{-1}$] and represents revolutions per minute.

The current polishing time is a time from the start of polishing of the substrate to a point of time at which the current thickness of the conductive film recited in the equation (10) is obtained. This current polishing time is measured by the processor 5 as described above. Alternatively, the current polishing time may be calculated from the total number of rotations of the polishing table 30 using the following equation (11).

$$\text{The current polishing time} = (\text{the total number of rotations of the polishing table}) \times (60/TS) \tag{11}$$

The total number of rotations of the polishing table 30 is the number of rotations of the polishing table 30 from the start of polishing of the conductive film up to the present time.

The polishing of the conductive film is terminated when the above-described target polishing time is reached. More specifically, the polishing of the conductive film is terminated when the additional polishing time has elapsed from a point of time when the current thickness of the conductive film is obtained. In this manner, the polishing end point is determined based not on the thickness of the conductive film, but on the polishing time. Therefore, the polishing precision finer than the amount of polishing per one rotation of the polishing table 30 can be realized. If the polishing method according to the above-discussed embodiment is not used, it is difficult to obtain the polishing precision finer than the amount of polishing per one rotation of the polishing table 30, because the eddy current film-thickness sensor 60 obtains the film thickness signal at each rotation of the polishing table 30. According to the above-described embodiment, the conductive film of the substrate W can be polished with precision that is finer than the amount of polishing per one rotation of the polishing table, because the target polishing time required for achieving the target thickness is calculated.

The previous description of embodiments is provided to enable a person skilled in the art to make and use the present invention. Moreover, various modifications to these embodiments will be readily apparent to those skilled in the art, and the genetic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing method, comprising:

rotating a polishing table that supports a polishing pad;

polishing a conductive film by pressing a substrate, having the conductive film formed on a surface thereof, against the polishing pad;

obtaining a film thickness signal, which varies in accordance with a thickness of the conductive film, with use of an eddy current film-thickness sensor disposed in the polishing table;

determining a thickness of the polishing pad based on the film thickness signal;

determining a polishing rate of the conductive film corresponding to the determined thickness of the polishing pad;

calculating an expected amount of polishing of the conductive film to be polished at the determined polishing rate for a predetermined polishing time;

calculating a temporary end-point film thickness by adding the expected amount of polishing to a target thickness of the conductive film; and terminating the polishing of the conductive film when the predetermined polishing time has elapsed from a point of time when the thickness of the conductive film has reached the temporary end-point film thickness.

2. The polishing method according to claim 1, wherein the polishing rate is determined from a polishing rate data indicating a relationship between thickness of the polishing pad and corresponding polishing rate.

3. The polishing method according to claim 1, wherein the film thickness signal comprises a resistance component and an inductive reactance component of an electric circuit of the eddy current film-thickness sensor, and wherein the thickness of the polishing pad is determined from a pad thickness data indicating a relationship between thickness of the polishing pad and impedance that is calculated from the resistance component and the inductive reactance component.

4. A polishing method, comprising:

rotating a polishing table that supports a polishing pad;

polishing a conductive film by pressing a substrate, having the conductive film formed on a surface thereof, against the polishing pad;

obtaining a thickness of the conductive film from output values of an eddy current film-thickness sensor disposed in the polishing table;

while polishing the conductive film, calculating an amount of polishing of the conductive film per one rotation of the polishing table based on the thickness of the conductive film obtained from output values of the eddy current film-thickness sensor;

calculating an additional polishing time from the amount of polishing of the conductive film and a difference between a current thickness of the conductive film and a target thickness;

calculating a target polishing time by adding the additional polishing time to a current polishing time at which the current thickness is obtained; and terminating the polishing of the conductive film when the target polishing time is reached.

* * * * *